US010544785B2

(12) United States Patent
Xu et al.

(10) Patent No.: US 10,544,785 B2
(45) Date of Patent: Jan. 28, 2020

(54) SCROLL COMPRESSOR WITH A LOCATING CRANKSHAFT

(71) Applicants: Daomin Xu, Taizhou (CN); Min Wang, Taizhou (CN)

(72) Inventors: Daomin Xu, Taizhou (CN); Min Wang, Taizhou (CN)

(73) Assignee: Zhejiang Jieneng Compression Equipment Co., Ltd., Taizhou (CN)

( * ) Notice: Subject to any disclaimer, the term of this patent is extended or adjusted under 35 U.S.C. 154(b) by 310 days.

(21) Appl. No.: 15/496,001

(22) Filed: Apr. 25, 2017

(65) Prior Publication Data

US 2017/0306962 A1 Oct. 26, 2017

(30) Foreign Application Priority Data

Apr. 25, 2016 (CN) ..... 2016 1 0265940
Apr. 25, 2016 (CN) ..... 2016 2 0356055 U
Aug. 31, 2016 (CN) ..... 2016 1 0796081

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 29/00*** | (2006.01) |
| ***F01C 17/06*** | (2006.01) |

(Continued)

(52) U.S. Cl.

CPC ..... *F04C 29/0057* (2013.01); *F01C 17/063* (2013.01); *F04C 18/0215* (2013.01); *F04C 29/04* (2013.01); *F04C 2230/603* (2013.01); *F04C 2240/50* (2013.01); *F04C 2240/805* (2013.01)

(58) Field of Classification Search

CPC .. F04C 18/0215; F04C 29/0057; F04C 29/04; F04C 2230/603; F04C 2240/50; F04C 2240/805; F01C 17/063

USPC ..... 418/55.1–55.6, 57, 270

See application file for complete search history.

(56) References Cited

U.S. PATENT DOCUMENTS 2,090,782 A * 8/1937 Carraway ..... F24F 3/044 165/260
2003/0223898 A1* 12/2003 Fujioka ..... F04C 18/0215 418/55.3

(Continued)

FOREIGN PATENT DOCUMENTS

CN 104847660 A 8/2015
CN 105041646 A 11/2015

*Primary Examiner* — Theresa Trieu
(74) *Attorney, Agent, or Firm* — Minder Law Group; Willy H. Wong

(57) ABSTRACT

A scroll compressor comprises a fixed bearing seat, a scroll fixed disk, a scroll orbiting disk, and an orbiting disk bearing seat. On the orbiting disk bearing seat, there are circumferentially three first bearing bores, and on the fixed bearing seat, there are circumferentially three second bearing bores. The front end of the locating crankshaft is rotatably connected inside the first bearing bore through the first bearing, and the rear end of the locating crankshaft is rotatably connected inside the second bearing bore through the second bearing. There is a through hole on the bottom face of the second bearing bore. The rear end of the locating crankshaft passes through the second bearing and is inserted inside the through hole. In addition, the end on which the locating crankshaft passes through the second bearing is screw connected with a locking nut.

10 Claims, 14 Drawing Sheets

(51) Int. Cl.
*F04C 18/02* (2006.01)
*F04C 29/04* (2006.01)

(56) References Cited

U.S. PATENT DOCUMENTS

| | | | | |
|---|---|---|---|---|
| 2004/0042920 | A1* | 3/2004 | Satoh | F04C 18/0215 418/55.3 |
| 2005/0220649 | A1* | 10/2005 | Sato | F04C 18/0215 418/55.3 |
| 2013/0149179 | A1* | 6/2013 | Sato | F04C 18/0215 418/55.3 |
| 2014/0119970 | A1* | 5/2014 | Kobayashi | F04C 18/0215 418/55.3 |

* cited by examiner

SCROLL COMPRESSOR WITH A LOCATING CRANKSHAFT

RELATED APPLICATIONS

This application claims benefit to Chinese Patent Application No. CN201620356055.0, filed Apr. 25, 2016; Chinese Patent Application No. CN201610265940.2, filed Apr. 25, 2016; and Chinese Patent Application No. CN201610796081.X, filed Aug. 31, 2016.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention pertains to the technical field of compressors, and relates to a scroll compressor.

Related Art

Due to the advantages of high efficiency, low noise, small size, being beneficial to save energy conservation and protect the environment, scroll air compressors are widely used in situations where compressed air is needed as in industry, agriculture, transportation, civil pneumatic power and some other industries. The main moving part of scroll air compressors is the scroll disk. The scroll disk only meshes and does not wear, so the service life is longer than that of piston compressors and screw compressors. They are ideal power source for pneumatic machines. In scroll air compressors, the scroll disk, as the main moving part, is divided into the orbiting disk and the fixed disk. Scrolls are arranged in the orbiting disk and the fixed disk. In general, the orbiting disk and the fixed disk match and form the compressing pocket. When the orbiting disk is driven by a crankshaft and translates along a certain circular path, the scroll of the orbiting disk moves relative to the scroll of the fixed disk. Hence, the compressing pocket formed by them moves and changes the volume, so as to implement suction, compression, discharge and then complete the air compression process.

One prior art low compression ratio and oil-free scroll air compressor assembly comprises a main housing and an orbiting scroll disk. The main housing is connected to the orbiting scroll disk inside the upper middle part of the main housing, through three auxiliary eccentric shafts. A fixed scroll disk is arranged above the orbiting scroll disk, and the rim of the fixed scroll disk is connected to the top end of the rim of the main housing. However, since it is required to position the bearings on both ends of the auxiliary eccentric shafts during the assembly process of the compressor, the auxiliary eccentric shafts are screw connected with nuts. When tightening or loosening the nuts, it is prone to rotate the auxiliary eccentric shafts. Namely, the three auxiliary eccentric shafts will rotate simultaneously and thus make the orbiting scroll disk move. Hence, it is difficult to truly tighten the nuts. Not only is the installation difficult, but also the bearings cannot be located precisely. This leads to a bigger fit error between the scroll orbiting disk and the scroll fixed disk and affects the service performance.

In addition, during the air compression process of the scroll compressor, a lot of heat will be generated and hence makes the scroll orbiting disk deform. This leads to a fit error between the scroll orbiting disk and the bearing, and meanwhile affects the fit error between the scroll fixed disk and the scroll orbiting disk. This eventually makes the service performance of the whole scroll compressor poor, and only low pressure air compression can be achieved.

SUMMARY OF THE INVENTION

One objective of one embodiment of the present invention is to avoid the issues stated above in the prior art, and to provide a scroll compressor. This scroll compressor can position the scroll orbiting disk precisely, and thus improves the performance of the scroll compressor.

One objective of one embodiment of present invention can be achieved by the following technical proposal:

A scroll compressor comprises a fixed bearing seat, a scroll fixed disk, a scroll orbiting disk and an orbiting disk bearing seat. The scroll fixed disk is fixed to the fixed bearing seat, and the orbiting disk bearing seat is located inside the fixed bearing seat. The scroll orbiting disk is fixed to the orbiting disk bearing seat, and the scroll orbiting disk matches the scroll fixed disk. On the end face of the orbiting disk bearing seat, there are circumferentially three first bearing bores, and on the end face of the fixed bearing seat, there are circumferentially three second bearing bores corresponding to three first bearing bores. A locating crankshaft is arranged between the corresponding first bearing bore and the second bearing bore. The front end of the locating crankshaft is rotatably connected inside the first bearing bore through the first bearing, and the rear end of the locating crankshaft is rotatably connected inside the second bearing bore through the second bearing. It is characterized in that:

There is a through hole on the bottom face of the second bearing bore, passing through the rear end of the fixed bearing seat. The rear end of the locating crankshaft passes through the second bearing and is inserted inside the through hole. In addition, the end on which the locating crankshaft passes through the second bearing is screw connected with a locking nut for locating the second bearing. A locating structure is also arranged on the rear end of the locating crankshaft to prevent the locating crankshaft from rotating when the locking nut is tightened.

There are both two first bearings and two second bearings. In order to pair the bearings, multiple first bearing bores are circumferentially and equally spaced on the orbiting disk bearing seat, and several second bearing bores are circumferentially and equally spaced on the fixed bearing seat. At assembly time, the scroll orbiting disk is fixed and installed onto the orbiting disk bearing seat in advance. There are several locating crankshafts. For each locating crankshaft, two first bearings are sleeved over its one end, and two second bearings are sleeved over its other end. Each locating crankshaft is mated with the corresponding first bearing bore and the second bearing bore, respectively. Namely, the first bearing will be pressed into the first bearing bore, and then the locating crankshaft will be maneuvered to allow the second bearings on multiple locating crankshafts to be aligned with and pressed into the second bearing bores. At this point, the scroll orbiting disk can rotate on the fixed bearing seat, and multiple locating crankshafts can synchronically rotate as well. For this purpose, through holes are set on the fixed bearing seat, and the ends of the locating crankshaft can insert into the through holes. Locking nuts are screwed onto the locating crankshafts. In operation, the locating crankshaft is circumferentially located by matching wrenches or other tools with the locating structure of the locating crankshaft, and then the locking nuts are tightened by wrenches or other tools to allow the locking nuts to press and stay firm onto the second bearings, achieving a precise positioning of the scroll orbiting disk. During the locating operation, the locating structure can effectively prevent the locating crankshaft from rotating, making the operation easier and more convenient, and hence simplifying the whole assembly process.

In one embodiment of the scroll compressor, on the outer wall of the rear end of the locating crankshaft, there are circumferentially external threads, and the locking nut fits the external threads of the locating crankshaft. When the locking nut is tightened, the locking nut presses against the inner end face of the inner race of the second bearing. The fact that locking nut fits the thread of the locating crankshaft simplifies the structure and operation, locates the inner race of the second bearing, and the stability is high.

In one embodiment of the scroll compressor, the locking nut is an external hex nut. An external hex nut is a nut of a conventional structure, and the operation is convenient. During the real manufacturing process, the cross section of the locking nut may also be machined into a polygon, and the locking nut can be turned by clamping its outer walls.

In one embodiment of the scroll compressor, several operation holes are arranged circumferentially on the rear end face of the locking nut, or several operation dents are arranged circumferentially along the edge of the rear end face of the locking nut. This structure is designed to turn the locking nut through its end face. Specifically, several operation holes are arranged on the end face of the locking nut, or several operation dents are arranged along the edge of the end face of the locking nut. It is sufficient to turn the locking nut by setting wrenches or other tools on the end of the locating crankshaft and attaching them to the locking nut.

In one embodiment of the scroll compressor, the locating structure comprises a locating part located on the rear end face of the locating crankshaft. A straight slot or cross slot or several locating holes are arranged on the end face of the locating part. No matter whether the locating part stretches out of the through hole, either the straight slot or the cross slot can be located by a screwdriver, and several locating holes can also be circumferentially located by screwdrivers or other tools. Of course, the structure of straight slot, cross slot or locating holes may also be directly arranged on the end face of the locating crankshaft.

In one embodiment of the scroll compressor, the locating structure comprises a locating part located on the rear end face of the locating crankshaft. The locating part is flat or is a column with a polygonal cross section. The locating part stretches out of the through hole or the locating part is located outside the through hole. This structure achieves the circumferential location of the locating crankshaft by clamping the locating part. Therefore, the locating part only requires the outer wall to be easily clamped. The structure is simple and the operation is convenient.

In one embodiment of the scroll compressor, the locating crankshaft comprises a disk-shaped crank arm. Perpendicularly, there is a columnar first transmission part on one side of the crank arm, and perpendicularly, there is a columnar second transmission part on the other side of the crank arm. The first transmission part and the second transmission part are arranged in parallel but eccentrically. The first transmission part is connected to the first bearing, and the second transmission part is connected to the second bearing. When the second transmission part is rotating, the first transmission part circumferentially moves around the axis line of the second transmission part, achieving the rotation of the scroll orbiting disk.

In one embodiment of the scroll compressor, there is an abutting edge on the side of the crank arm, surrounding the second transmission part. When the locking nut is tightened, the outer end face of the inner race of the second bearing presses against the end face of the abutting edge. The abutting edge, combined with the locking nut, clamping the inner end of the second bearing, so as to axially position the inner race of the second bearing.

In one embodiment of the scroll compressor, the second locking plate is fixed to the fixed bearing seat, and an adjusting gasket is arranged between the second bearing and the bottom face of the second bearing bore. The second locking plate presses against the outer end face of the outer race of the second bearing. Under the action of the second locking plate, the inner end face of the outer race of the second bearing presses against the adjusting gasket. The second locking plate is used to axially position the second bearing. An adjusting gasket is arranged inside the second bearing bore to eliminate the axial clearance error. Specifically, the assembly process of the present scroll compressor is that, the scroll orbiting disk is fixed and installed onto the orbiting disk bearing seat in advance, and then the first locking plate, the second locking plate, two first bearings and two second bearings are sleeved over the locating crankshaft. Two first bearings are pressed into the first bearing bore on the orbiting disk bearing seat, and the first locking plate is fixed to the orbiting disk bearing seat. The orbiting disk bearing seat, the first bearings, the first locking plate, the locating crankshaft and the second bearings are installed in place, the clearance errors among them are eliminated, and then the distance from the blades of the scroll orbiting disk to the end face of the second bearing is measured. According to the measurement and the designed distance from the scroll fixed disk to the fixed bearing seat, an accurate distance from the end face of the second bearing to the bottom face of the second bearing bore after the scroll orbiting disk and the scroll fixed disk are precisely assembled can be figured out. Hence, an adjusting gasket of an appropriate thickness will be selected. This makes the assembly more convenient, and the fit precision between the scroll orbiting disk and the scroll fixed disk after the assembly is higher.

In one embodiment of the scroll compressor, the first locking plate is fixed to the orbiting disk bearing seat, and the first locking plate presses against the outer end face of the outer race of the first bearing. There is an abutting boss on the side of the crank arm, surrounding the first transmission part, and the abutting boss presses against the outer end face of the inner race of the first bearing. The first locking plate is used to axially position the outer race of the first bearing, and the abutting boss is used to axially position the inner race of the first bearing, so as to position the first bearing, making the assembly more precise.

In order to avoid the fit error between the scroll orbiting disk and the bearing during the operation process, and hence the precision is reduced. In the scroll compressor, there are several long stripped heat sinks on the back of the scroll orbiting disk. These heat sinks are arranged in the same direction, and air ducts are formed in between two adjacent heat sinks. Each heat sink is bended into a wave shape and the wave-shaped heat sink has several peaks and several troughs in the lengthwise direction. The locations of peaks and troughs in two adjacent heat sinks are aligned. In any heat sink, there is at least one peak located in a triangular zone, which is enclosed by the corresponding peak on the heat sink above and the two troughs on two sides of that peak on that same heat sink. Therefore, in one transversal section, there are several heat sinks to reinforce the strength of the disk body. The stiffening effect is significant, so as to prevent the disk body from deforming and to avoid the fit error among the scroll orbiting disk, the scroll fixed disk and the bearings.

Furthermore, there is the first prop, which is columnar and perpendicular to the back of the disk body, in the peak or trough area of the heat sink, and the outer diameter of the first prop is greater than the thickness of the heat sink. On the back of the disk body, there are three columnar second props perpendicular to the back of the disk body. The second props are located on the heat sinks and the lines connecting the three second props form an isosceles triangle or equilateral triangle. This stiffens the scroll orbiting disk, and plays the role of a supporting frame.

Compared to the prior art, one embodiment of the scroll compressor has the following advantages:

1. Since the locating crankshaft is circumferentially positioned by a locating structure through the locating structure when turning the locking nut, and the locating crankshaft is prevented from rotating, the operation is easier and more convenient, and hence the assembly process is simplified.

2. Since an adjusting gasket is arranged inside the second bearing bore, all the clearance errors possibly existing among the components of the locating crankshaft can be transferred to the end of the locating crankshaft; namely, between the second bearing and the bottom face of the second bearing bore. Then an appropriate adjusting gasket is selected in advance for the assembly according to the calculation. The assembly is more convenient, and the fit precision between the scroll orbiting disk and the scroll fixed disk after the assembly is higher.

3. With special heat sinks designed on the scroll orbiting disk, the scroll orbiting disk will not deform due to overheat during the operation process and hence effects the matching relation between the scroll orbiting disk and the bearing. This improves the matching relation between the scroll orbiting disk and the bearing, also improves the fit precision between the scroll fixed disk and the scroll orbiting disk during the operation process, and can achieve the compression of high pressure air.

DETAILED DESCRIPTION OF THE INVENTION

The embodiments of this invention will be described below and the technical solutions of the invention will be further illustrated in connection with the accompanying figures. However, the present invention shall not be limited to these embodiments.

First Embodiment

Figure 1:
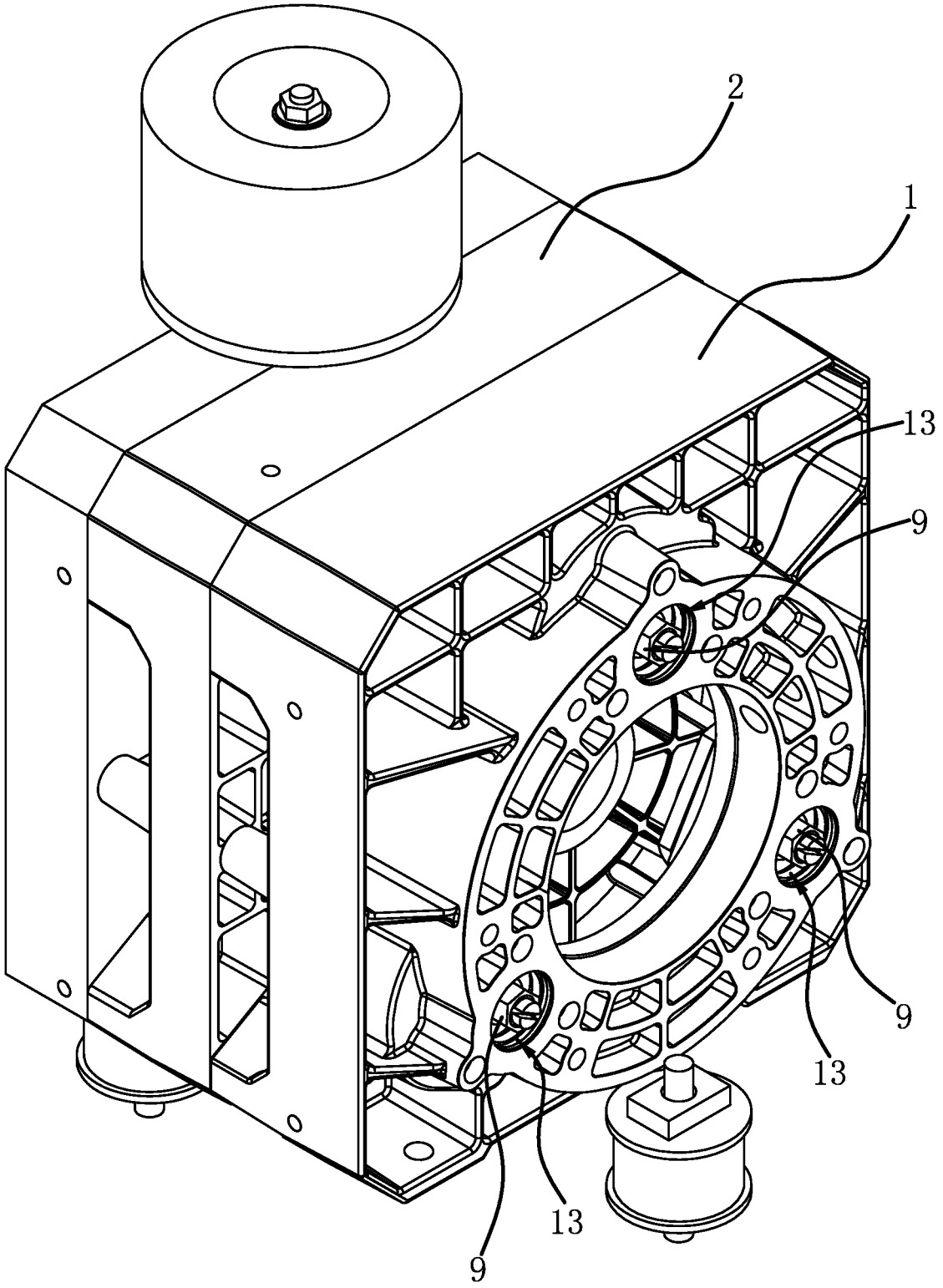
FIG. 1 is a perspective view of one embodiment of the scroll compressor while the motor is not installed yet.
Figure 2:
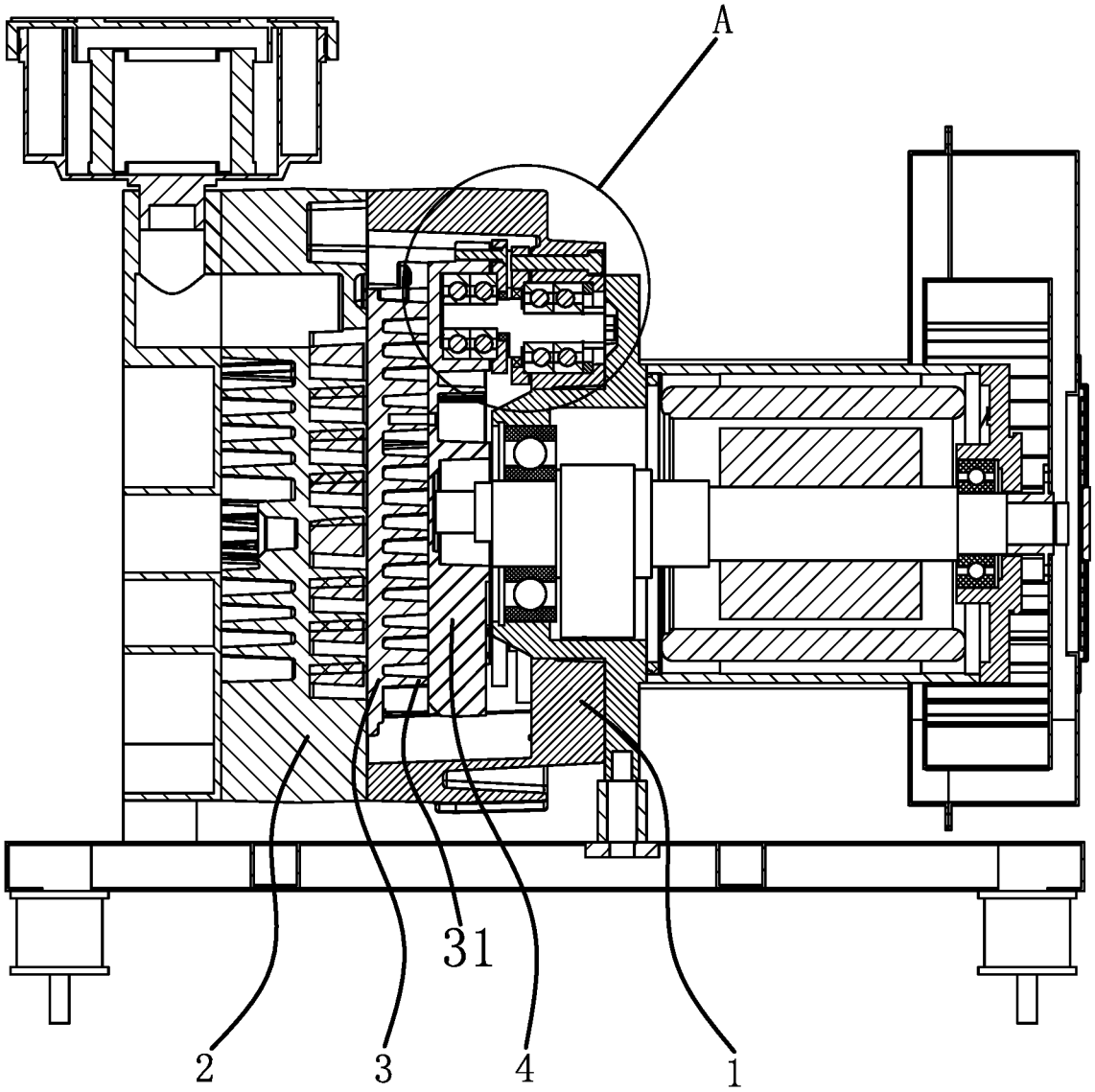
FIG. 2 is a sectional view of one embodiment of the scroll compressor.
Figure 3:
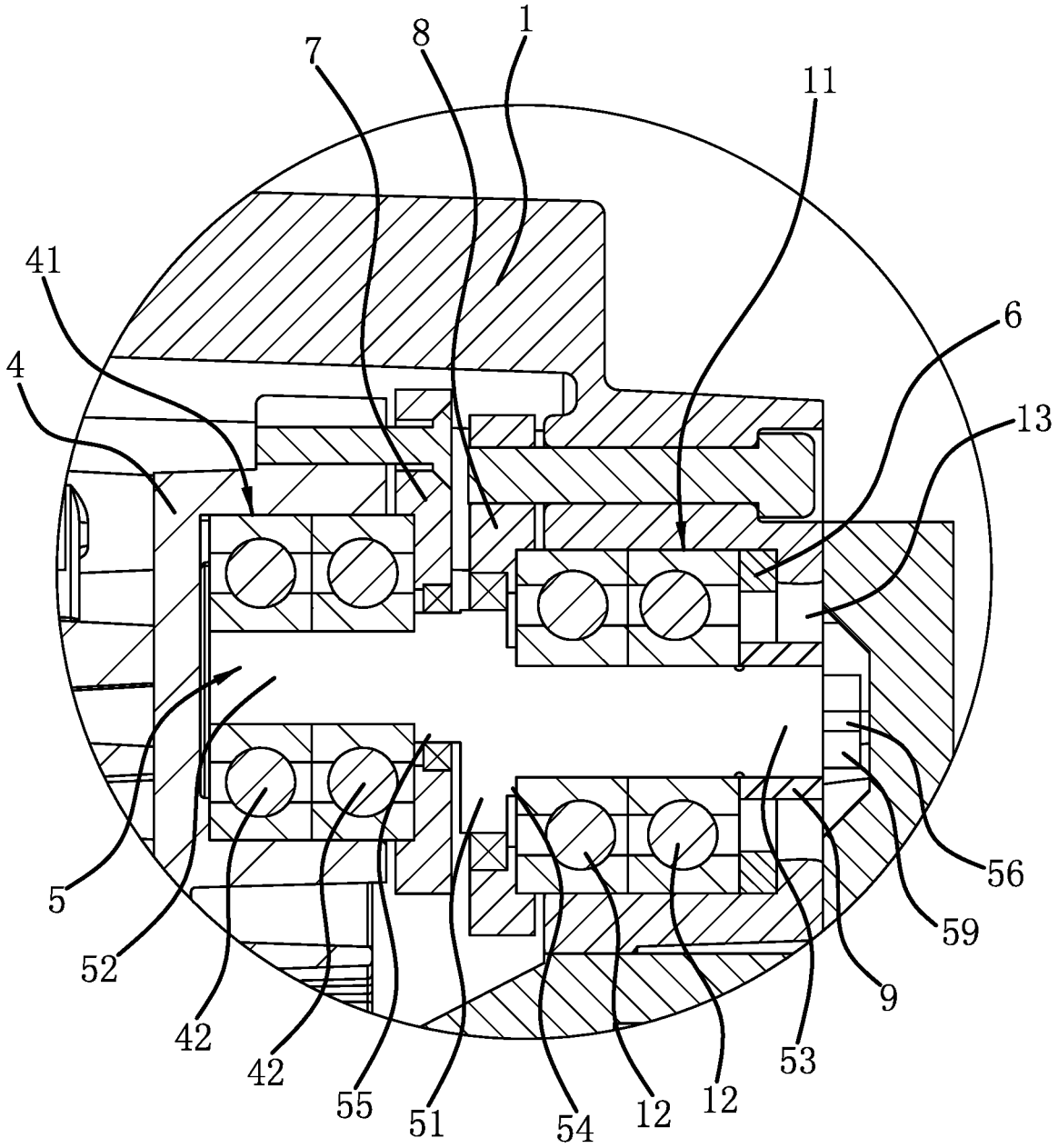
FIG. 3 is a detailed view of Section A in FIG. 2.

As shown in FIG. 1, FIG. 2, and FIG. 3, a scroll compressor comprises a fixed bearing seat (1), a scroll fixed disk (2), a scroll orbiting disk (3) and an orbiting disk bearing seat (4). The scroll fixed disk (2) is fixed to the fixed bearing seat (1), and the orbiting disk bearing seat (4) is located inside the fixed bearing seat (1). The scroll orbiting disk (3) is fixed to the orbiting disk bearing seat (4), and the scroll orbiting disk (3) matches the scroll fixed disk (2). On the end face of the orbiting disk bearing seat (4), there are circumferentially three equally spaced first bearing bores (41), and on the end face of the fixed bearing seat (1), there are circumferentially three equally spaced second bearing bores (11). The second bearing bores (11) correspond with the first bearing bores (41) one-to-one. A locating crankshaft (5) is arranged between the corresponding first bearing bore (41) and second bearing bore (11). The front end of the locating crankshaft (5) is rotatably connected inside the first bearing bore (41) through the first bearing (42), and the rear end of the locating crankshaft (5) is rotatably connected inside the second bearing bore (11) through the second bearing (12). There are both two first bearings (42) and two second bearings (12) and they are paired bearings. There is a through hole (13) on the bottom face of the second bearing bore (11), and the through hole (13) passes through the rear end of the fixed bearing seat (1). The rear end of the locating crankshaft (5) passes through the second bearing (12) and is inserted inside the through hole (13). In addition, the end on which the locating crankshaft (5) passes through the second bearing (12) is screw connected with a locking nut (9). Specifically, on the outer wall of the rear end of the locating crankshaft (5), there are circumferentially external threads, and the locking nut (9) fits the external threads of the locating crankshaft (5). When the locking nut (9) is tightened, the locking nut (9) presses against the inner end face of the inner race of the second bearing (12). A locating structure is also arranged on the rear end of the locating crankshaft (5) to prevent the locating crankshaft (5) from rotating when the locking nut (9) is tightened.

Figure 4:
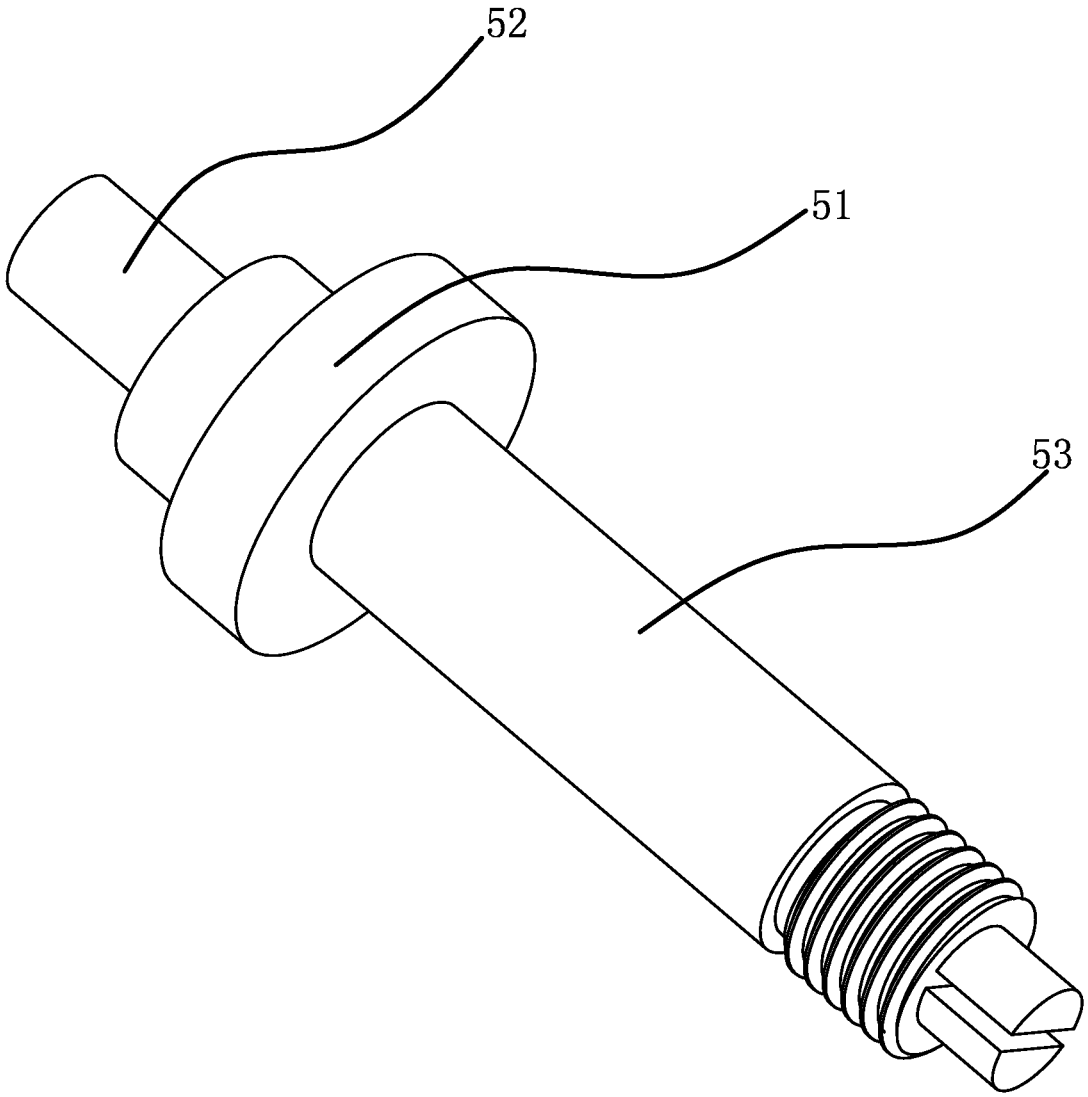
FIG. 4 is a perspective view of one embodiment of the locating crankshaft.
Figure 5:
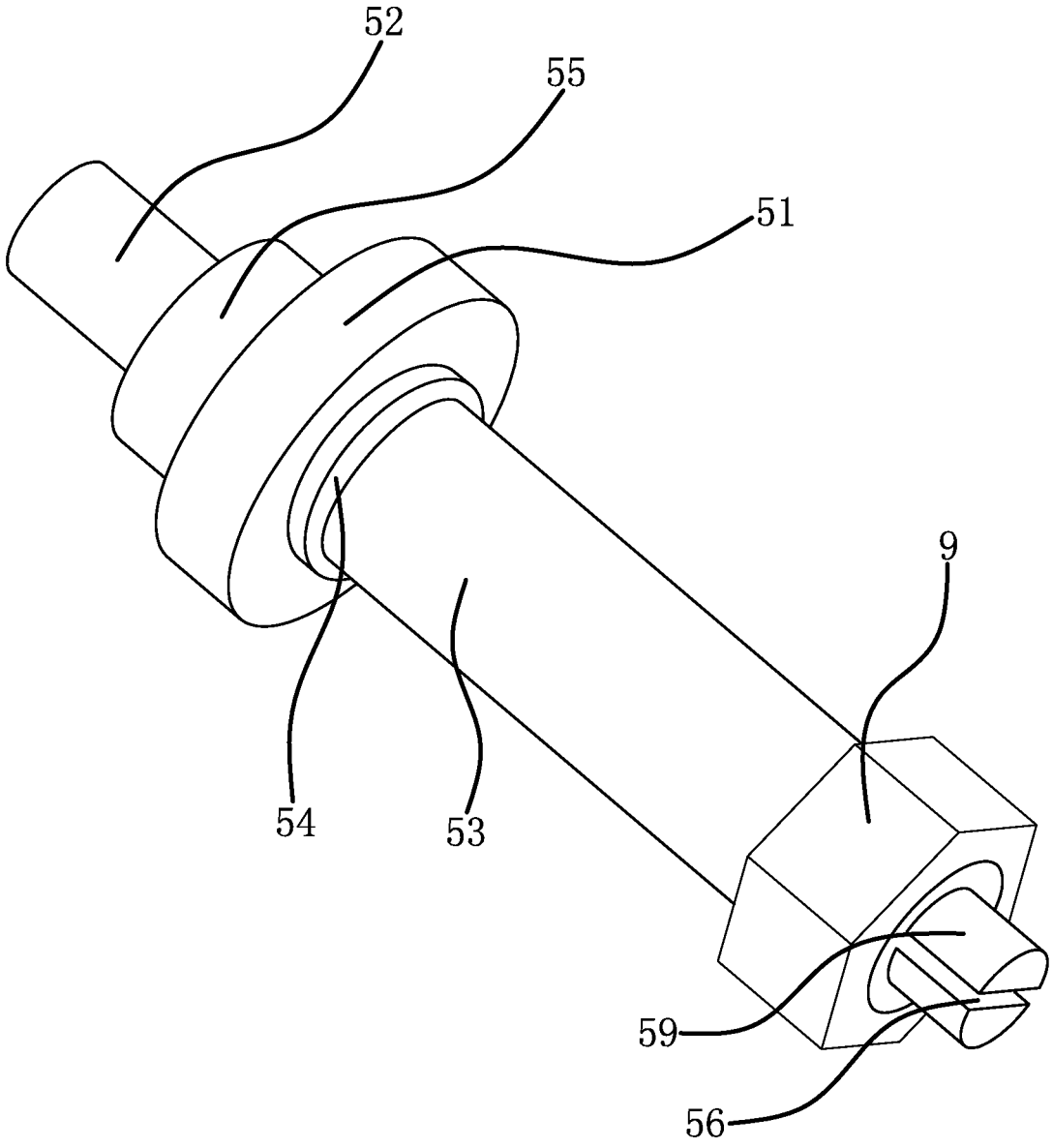
FIG. 5 is a perspective view of one embodiment of the locating crankshaft while the locking nut is an external hex nut.

Specifically, as shown in FIG. 4 and FIG. 5, the locking nut (9) is an external hex nut. An external hex nut is a nut of a conventional structure, and the operation is convenient. During the real manufacturing process, the locking nut (9) may also be machined into a structure with the cross section of a polygon, and the locking nut (9) can be turned by clamping its outer walls. The locating structure comprises a locating part (59) on the end face of the locating crankshaft (5). A straight slot (56) is arranged on the end face of the locating part (59). The locating crankshaft (5) can be positioned through a screwdriver.

The locating crankshaft (5) comprises a disk-shaped crank arm (51). Perpendicularly, there is a columnar first transmission part (52) on one side of the crank arm (51). There is an abutting boss (55) on the side of the crank arm (51), surrounding the first transmission part (52). The first locking plate (7) is fixed to the orbiting disk bearing seat (4), and the first locking plate (7) presses against the outer end face of the outer race of the first bearing (42), axially positioning the outer race of the first bearing (42). The abutting boss (55) presses against the outer end face of the inner race of the first bearing (42), axially positioning the inner race of the first bearing (42). This achieves positioning the first bearing (42), and makes the assembly more precise. Perpendicularly, there is a columnar second transmission part (53) on the other side of the crank arm (51). The first transmission part (52) and the second transmission part (53) are arranged in parallel but eccentrically. There is an abutting edge (54) on the side of the crank arm (51), surrounding the second transmission part (53). When the locking nut (9) is tightened, the outer end face of the inner race of the second bearing (12) presses against the end face of the abutting edge (54). The abutting edge (54), combined with the locking nut (9), clamping the inner end of the second bearing (12), so as to axially position the inner race of the second bearing (12). The second locking plate (8) is fixed to the fixed bearing seat (1), and an adjusting gasket (6) is arranged between the second bearing (12) and the bottom face of the second bearing bore (11). The second locking plate (8) presses against the outer end face of the outer race of the second bearing (12). Under the action of the second locking plate (8), the inner end face of the outer race of the second bearing (12) presses against the adjusting gasket (6).

At assembly time, the scroll orbiting disk (3) is fixed and installed onto the orbiting disk bearing seat (4) in advance. There are three locating crankshafts (5). The first locking plate (7) and the second locking plate (8) are sleeved over both ends of the locating crankshaft (5). Two first bearings (42) are sleeved over one end of the locating crankshaft (5), and two second bearings (12) are sleeved over the other end of the locating crankshaft (5), and then two first bearings (42) are pressed into the first bearing bores (41) on the orbiting disk bearing seat (4). The first locking plate (7) is fixed to the orbiting disk bearing seat (4), making the first locking plate (7) presses the first bearing (42) firm. The orbiting disk bearing seat (4), the first bearings (42), the first locking plate (7), the locating crankshaft (5) and the second bearings (12) are installed in place, and the clearance errors among them are eliminated. Since all the components mentioned above are installed axially, the assembly process is relatively simple and the assembly precision is relatively high. Then the distance from the blades of the scroll orbiting disk (3) to the end face of the second bearing (12) is measured. According to the measurement and the designed distance from the scroll fixed disk (2) to the fixed bearing seat (1), an accurate distance from the end face of the second bearing (12) to the bottom face of the second bearing bore (11) after the scroll orbiting disk (3) and the scroll fixed disk (2) are precisely assembled can be figured out. Hence, an adjusting gasket (6) of an appropriate thickness will be selected. This adjusting gasket (6) is placed inside the second bearing bore (11). The locating crankshaft (5) will be maneuvered to allow the second bearings (12) on the locating crankshafts (5) to be aligned with and pressed into the second bearing bores (11). The second locking plate (8) is fixed to the fixed bearing seat (1). This makes the second locking plate (8) press the second bearing (12) firm, and the second bearing (12) press the adjusting gasket (6) firm, and achieves a higher fit precision between the scroll orbiting disk (3) and the scroll fixed disk (2) after the assembly process. At this point, the scroll orbiting disk (3) can rotate on the fixed bearing seat (1), and three locating crankshafts (5) can synchronically rotate as well. The ends of the locating crankshafts (5) can insert into the through holes (13). Locking nuts (9) are screwed onto the locating crankshafts (5). In operation, the locating crankshaft (5) is circumferentially located by matching a slot screwdriver with the straight slot (56) of the locating crankshaft (5), and then the external hex nut is clamped with and tightened by a wrench to allow the locking nuts (9) to press and locate onto the second bearings (12), achieving a precise positioning of the scroll orbiting disk (3). During the locating operation, this can effectively prevent the locating crankshaft (5) from rotating, making the operation easier and more convenient, and hence simplifying the whole assembly process.

Figure 13:
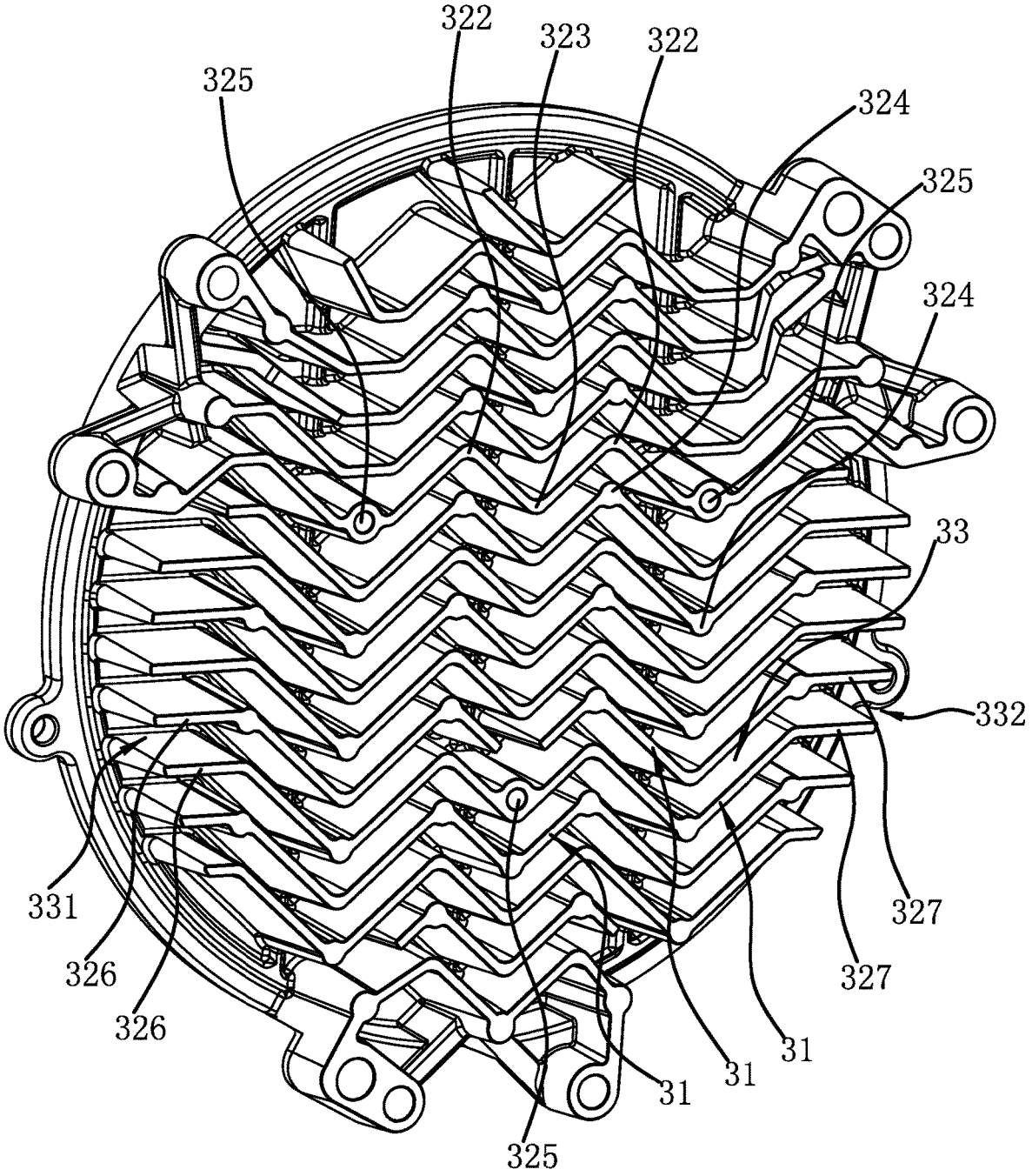
FIG. 13 is a perspective view of one embodiment of the scroll orbiting disk.
Figure 14:
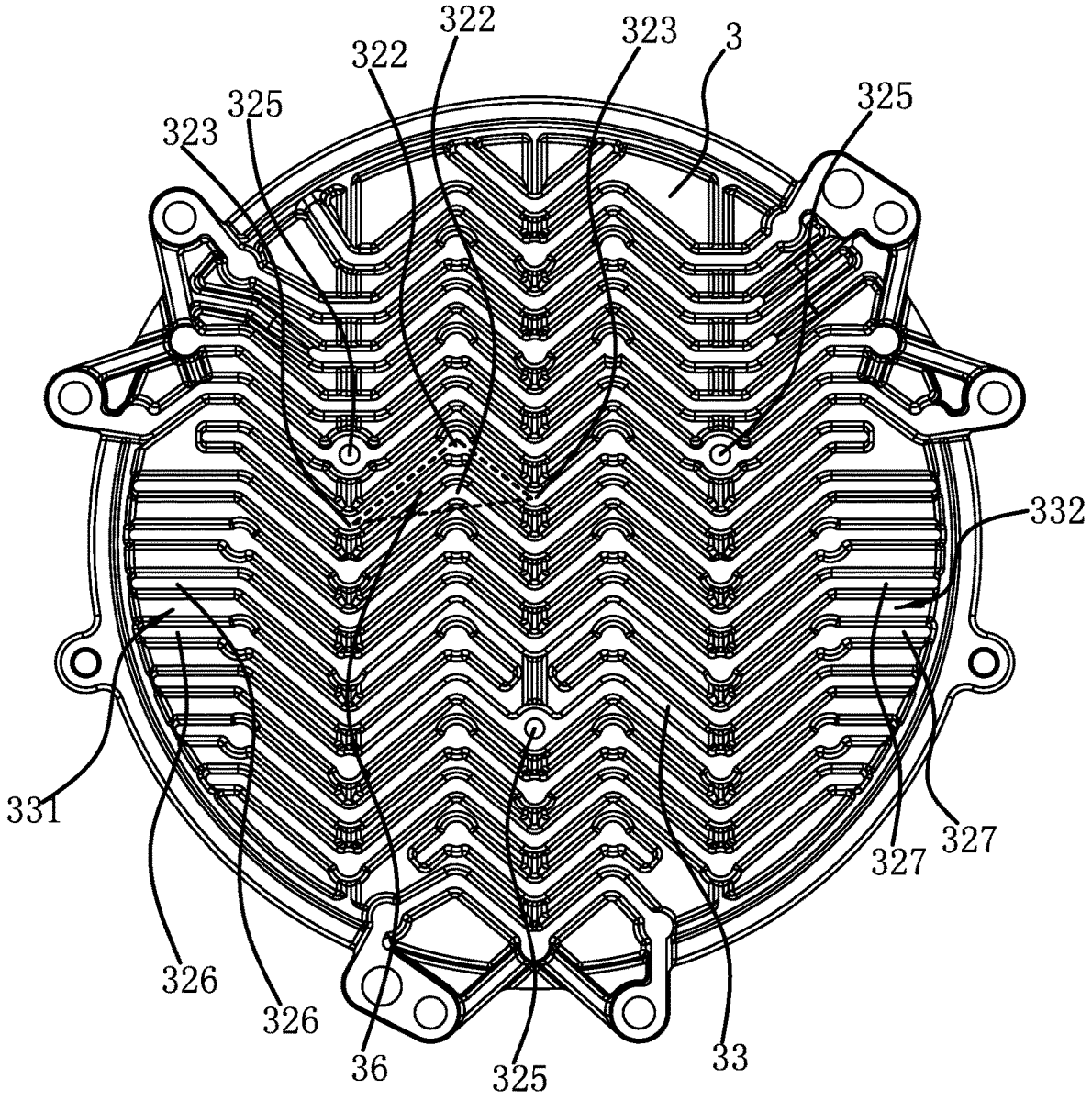
FIG. 14 is a rear view of FIG. 13.

As shown in FIG. 13 and FIG. 14, the scroll is arranged on the front face of the scroll orbiting disk (3) in a spiral manner. There are several long stripped heat sinks (31) on the back of the scroll orbiting disk (3), and the widthwise direction of the heat sink (31) is perpendicular to the back of the scroll orbiting disk (3). These heat sinks (31) are arranged in the same direction, and an air duct (33) is formed in between two adjacent heat sinks (31). Both ends of the heat sink (31) extend to the outer rim of the scroll orbiting disk (3). There is a flat and straight inlet part (326) on one end of the heat sink (31), and a flat and straight outlet part (327) on the other end. The inlet part (326) and the outlet part (327) on one heat sink (31) are arranged symmetrically. An air inlet (331) connected to the air duct (33) is formed in between the inlet parts (326) of two adjacent heat sinks (31), and an air outlet (332) connected to the air duct (33) is formed in between the outlet parts (327) of two adjacent heat sinks (31). A fan is also arranged on the scroll compressor, and the air flow generated by the fan, as well as the natural wind, can blow the sides of the scroll orbiting disk (3). The air flow blows into one end of the air duct (33), and out of the other end. During the process the air flow passing through the air duct (33), the heat on the scroll orbiting disk (3) and the heat sinks (31) can be taken away, and hence the temperature will be reduced. Also, reducing the temperature of the scroll orbiting disk (3) helps prevent the scroll orbiting disk (3) from deforming because of high temperature.

The thickness of the heat sink (31) gradually increases from the top to the bottom. The connecting lines between the peak (322) of the heat sink (31) and its two adjacent troughs (323) are straight lines, and there is an angle between the lines connecting the peak (322) and its two adjacent troughs (323). This angle determines the bending degree of the wave-shaped heat sink (31). When this angle is too big, the stiffening effect is not significant. However, when the angle is too small, the resistive force against the air flow is also big. This is bad for the air flow to pass through. When the angle is 90°, the heat dissipation effect and stiffening effect of the scroll orbiting disk (3) is fairly good. The wave-shaped heat sink (31) has several peaks (322) and several troughs (323) in the lengthwise direction. The extending direction of the heat sinks (31) is the transversal direction, and the arranging direction of several heat sinks (31) is the longitudinal direction. Among of them, longer heat sinks (31) can reinforce the strength of the scroll orbiting disk (3) in the transversal direction. The direction of the line connecting the peak (322) and the adjacent trough (323) is inclined relative to the transversal direction of the scroll orbiting disk (3), to stiffen the scroll orbiting disk (3) in the longitudinal direction. The locations of peaks (322) and troughs (323) in two adjacent heat sinks (31) are aligned. In any heat sink (31), there is at least one peak (322) located in a triangular zone (36), which is enclosed by the corresponding peak (322) on the heat sink (31) above and the two troughs (323) on two sides of that peak (322) on that same heat sink (31). Therefore, in one transversal cross section, there are several heat sinks (31) to reinforce the strength of the scroll orbiting disk (3). The stiffening effect is significant, so as to prevent the scroll orbiting disk (3) from deforming. Therefore, the fit errors between the scroll orbiting disk (3) and the bearing and between the scroll orbiting disk (3) and the scroll fixed disk (2) will not be affected.

The heat sink (31) has the first prop (324), which is columnar and perpendicular to the back of the scroll orbiting disk (3), in either the peak (322) or the trough (323) area. The outer diameter of the first prop (324) is greater than the thickness of the heat sink (31), and the outer diameter of the first prop (324) gradually increases from the top to the bottom. The top end of the first prop (324) is flush with the top edge of the heat sinks (31), stiffening the heat sinks (31) and the scroll orbiting disk (3). On the back of the scroll orbiting disk (3), there are three columnar second props (325) perpendicular to it. The second props (325) are located in the heat sinks (31). Similarly, the outer diameter of the second prop (325) also increases from the top to the bottom, and the outer diameter of the second prop (325) is greater than the outer diameter of the first prop (324). Lines connecting the three second props (325) form a triangle, and thus play the role of supporting frame for the scroll orbiting disk (3). In this embodiment, lines connecting the three second props (325) form an equilateral triangle, achieving a uniform stiffening effect of the scroll orbiting disk (3).

Second Embodiment

Figure 6:
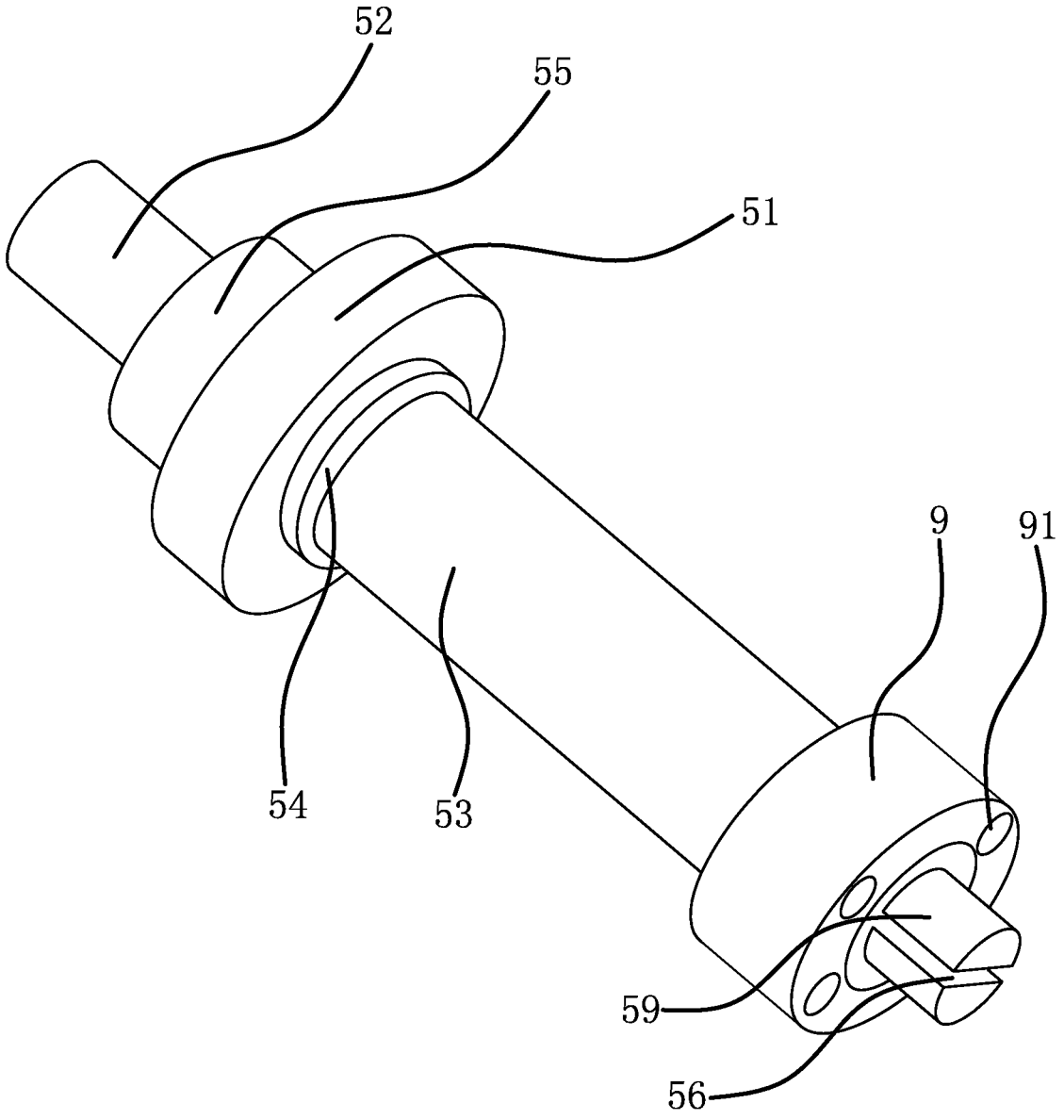
FIG. 6 is a perspective view of one embodiment of the locating crankshaft while operation holes are arranged on the locking nut.

The structure of this scroll compressor is basically the same as that of the first embodiment. The differences are:

As shown in FIG. 6, several operation holes (91) are circumferentially arranged on the rear end face of the locking nut (9). This structure is designed to implement the turning operation by pressing the end face of the locking nut (9) firm. It is sufficient to do so by setting wrenches or other tools on the end of the locating crankshaft (5) and attaching them to the locking nut (9).

Third Embodiment

Figure 7:
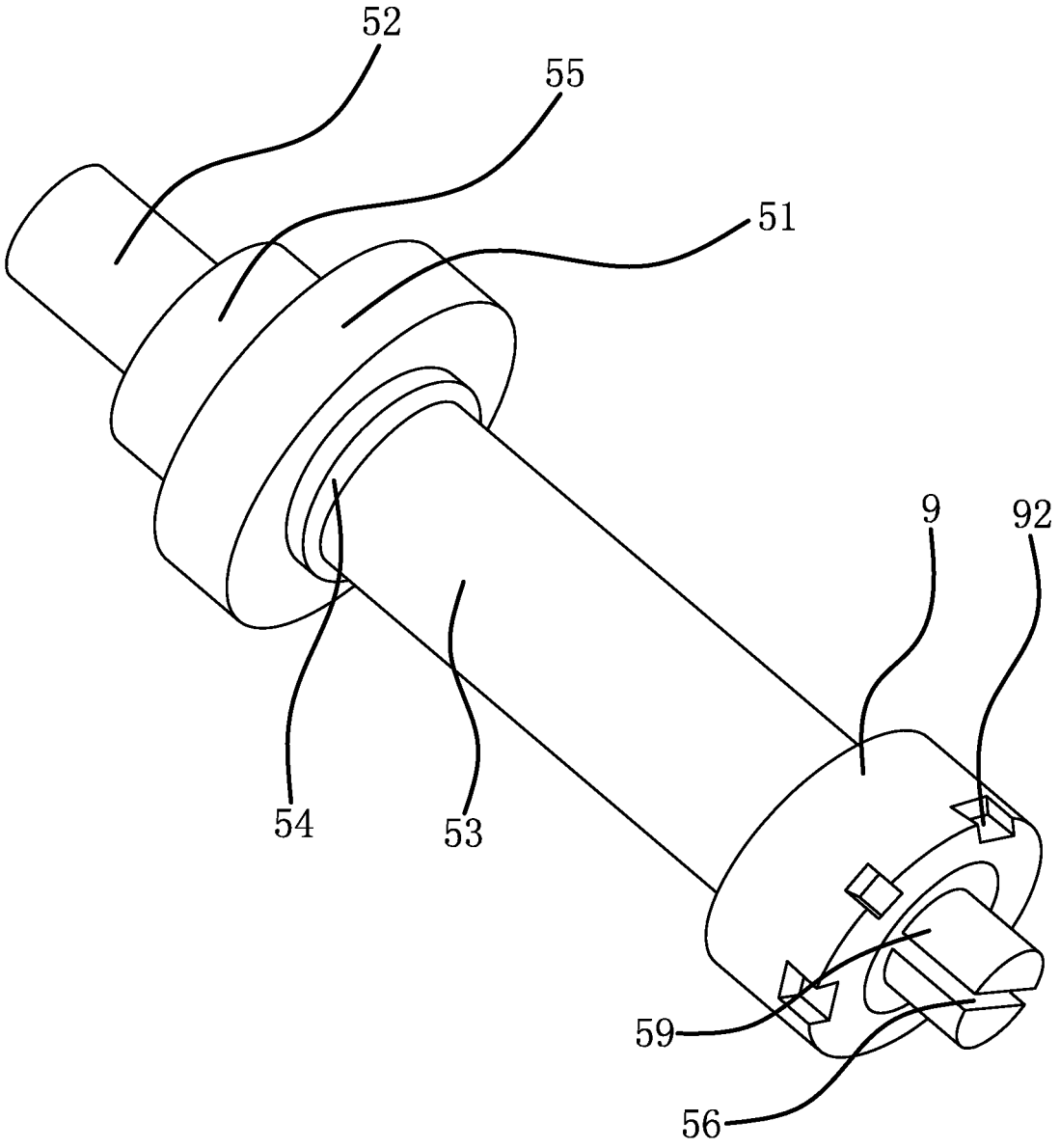
FIG. 7 is a perspective view of one embodiment of the locating crankshaft while operation dents are arranged on the locking nut.

The structure of this scroll compressor is basically the same as that of the first embodiment. The differences are:

As shown in FIG. 7, several operation dents (92) are circumferentially arranged on the end face of the locking nut (9). This structure is designed to implement the turning operation by pressing the end face of the locking nut (9) firm. It is sufficient to do so by setting wrenches or other tools on the end of the locating crankshaft (5) and attaching them to the locking nut (9).

Fourth Embodiment

Figure 8:
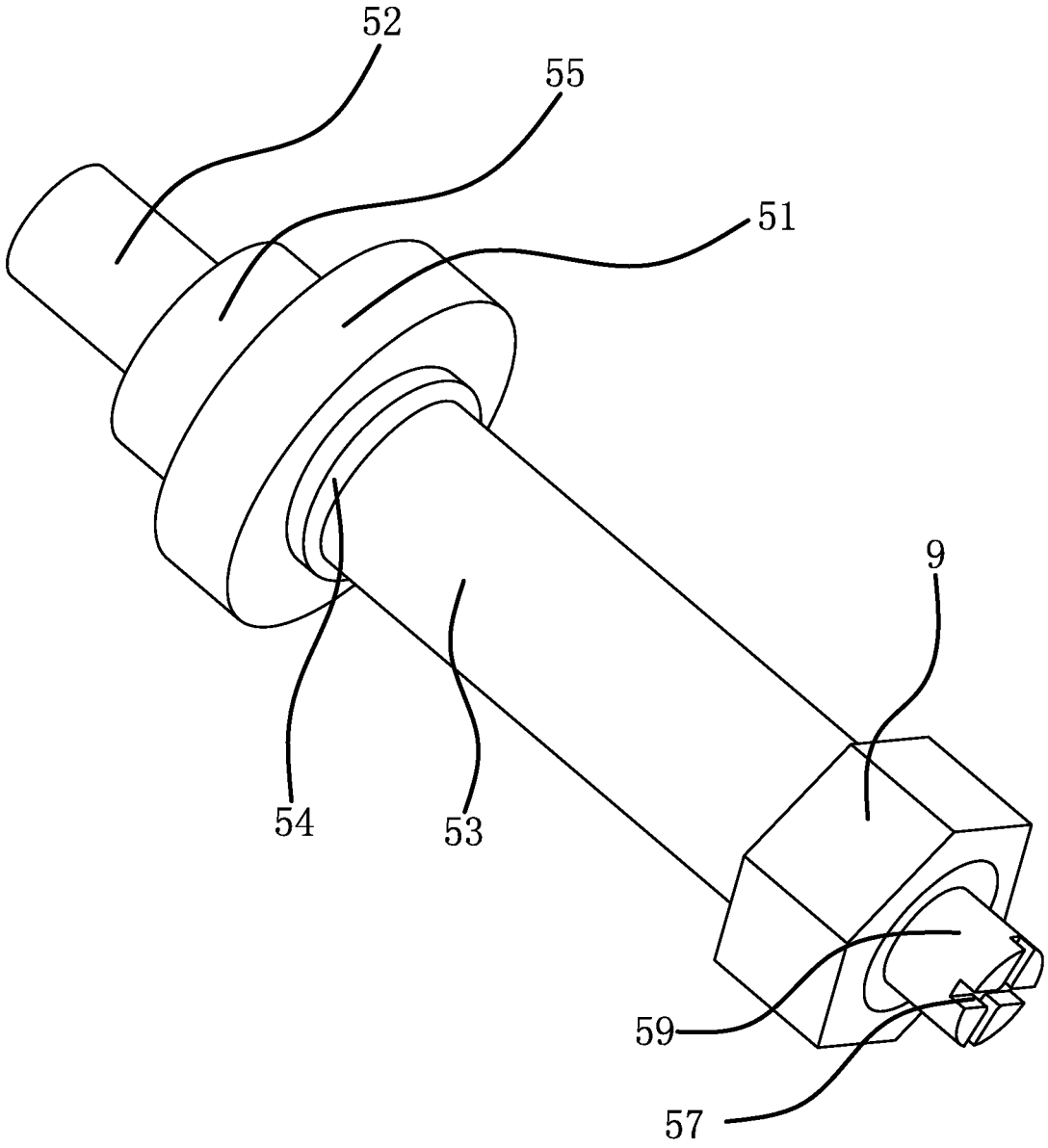
FIG. 8 is a perspective view of one embodiment of the locating crankshaft while a cross slot is arranged on the locating part.

The structure of the scroll compressor is basically the same as that of the first embodiment. The differences are:

As shown in FIG. 8, the locating structure comprises a locating part (59) on the end face of the locating crankshaft (5). A cross slot (57) is arranged on the end face of the locating part (59). The locating crankshaft (5) can be circumferentially positioned through a Phillips screwdriver.

Fifth Embodiment

Figure 9:
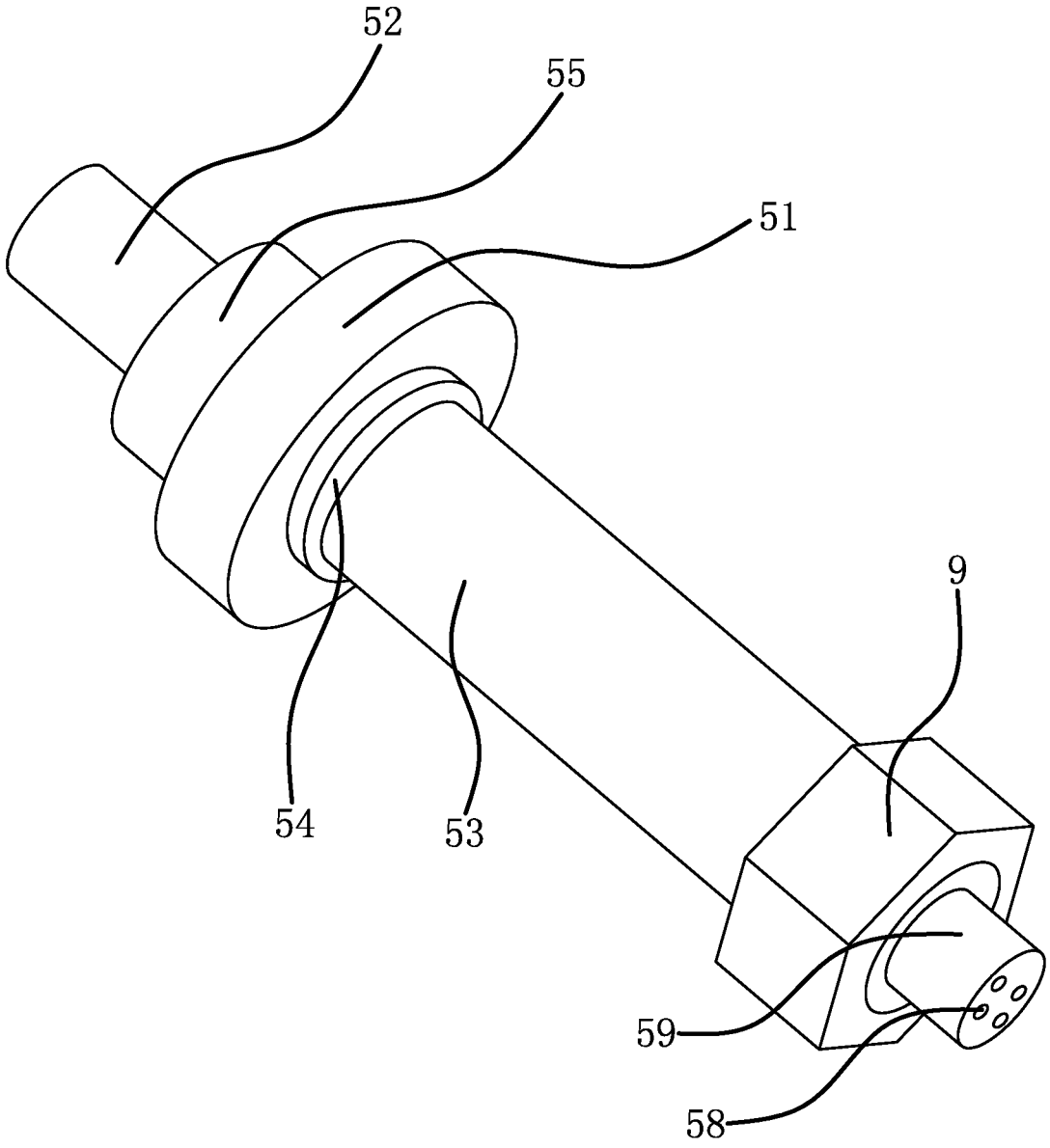
FIG. 9 is a perspective view of one embodiment of the locating crankshaft while a locating hole is arranged on the locating part.

The structure of the scroll compressor is basically the same as that of the first embodiment. The differences are:

As shown in FIG. 9, the locating structure comprises a locating part (59) on the end face of the locating crankshaft (5). Several locating holes (58) are arranged on the end face of the locating part (59). The locating crankshaft (5) can be circumferentially positioned by matching screwdrivers or other tools with several locating holes (58).

Sixth Embodiment

Figure 10:
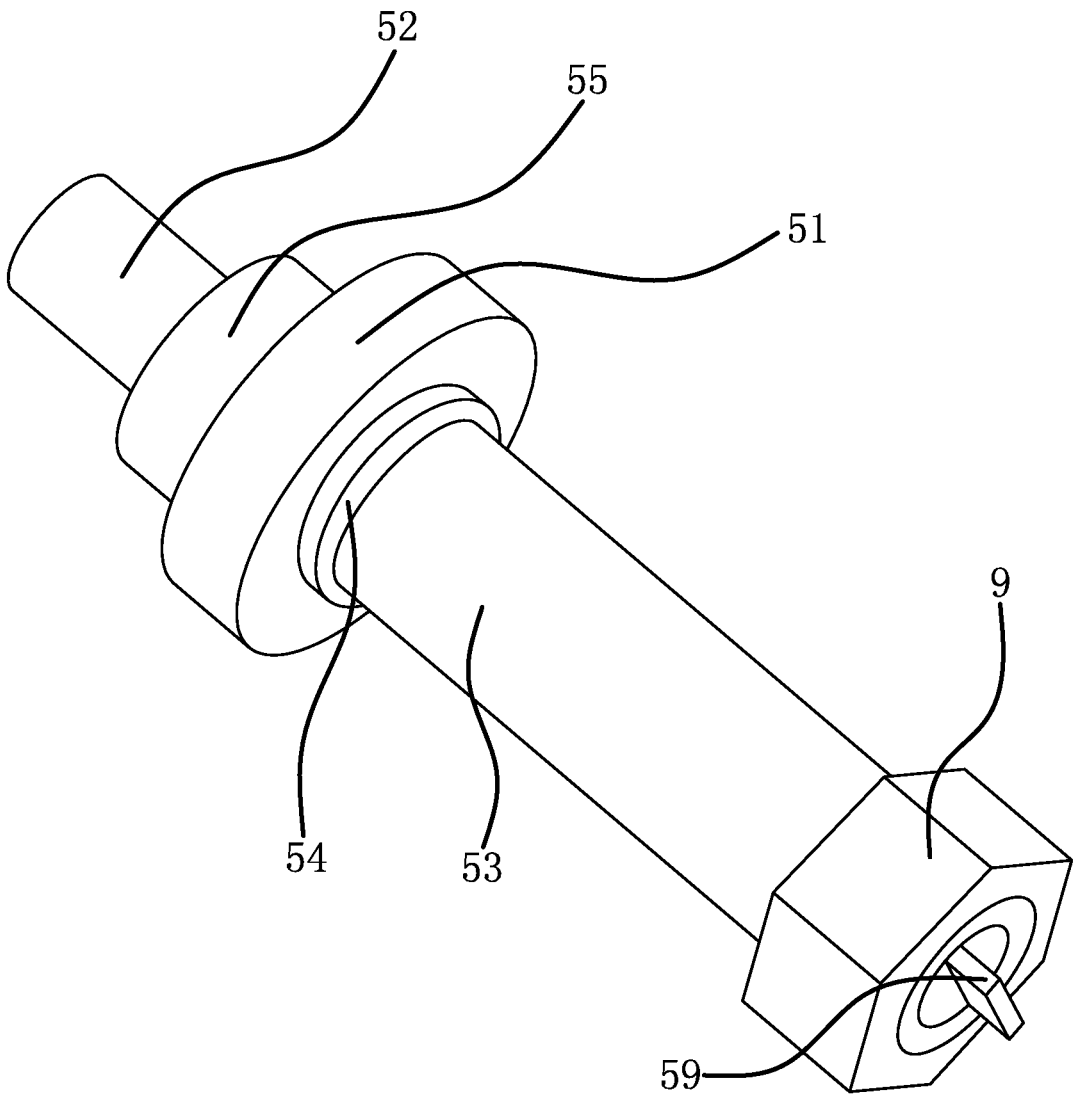
FIG. 10 is a perspective view of one embodiment of the locating crankshaft while the locating part is flat.

The structure of the scroll compressor is basically the same as that of the first embodiment. The differences are:

As shown in FIG. 10, the locating structure comprises a locating part (59) on the rear end face of the locating crankshaft (5). The locating part (59) is flat, and the outer end of the locating part (59) is outside the through hole (13). In this embodiment, the locating part (59) is outside the through hole (13), making the locating part (59) to be easily clamped.

Seventh Embodiment

Figure 11:
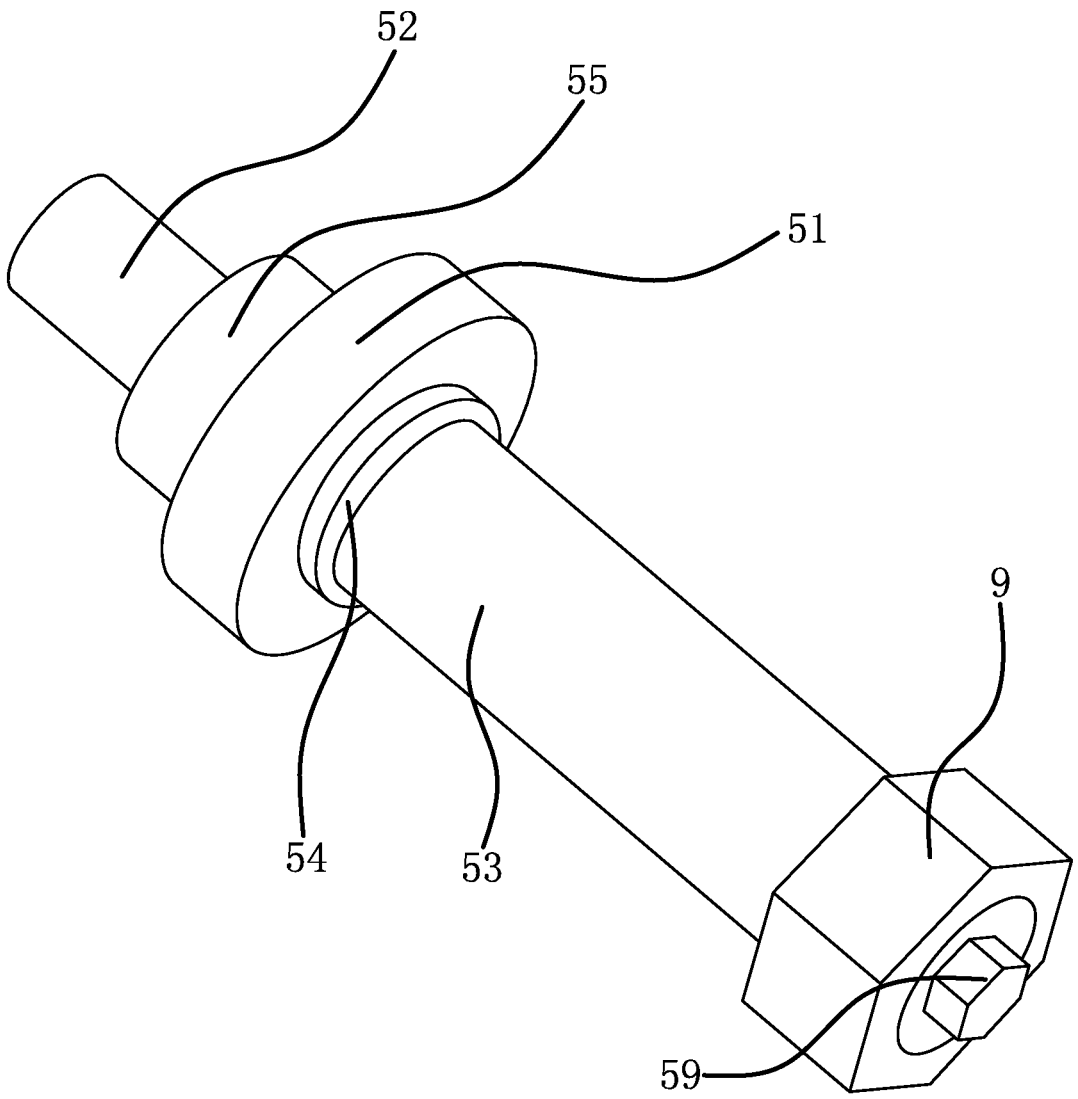
FIG. 11 is a perspective view of one embodiment of the locating crankshaft while the cross section of the locating part is a hexagon.

The structure of the scroll compressor is basically the same as that of the first embodiment. The differences are:

As shown in FIG. 11, the locating structure comprises a locating part (59) on the rear end face of the locating crankshaft (5). The cross section of the locating part (59) is a polygon, and the outer end of the locating part (59) is outside the through hole (13). In this embodiment, the locating part (59) is outside the through hole (13), and the cross section of the locating part (59) is a hexagon, making the locating part (59) to be easily clamped.

Eighth Embodiment

Figure 12:
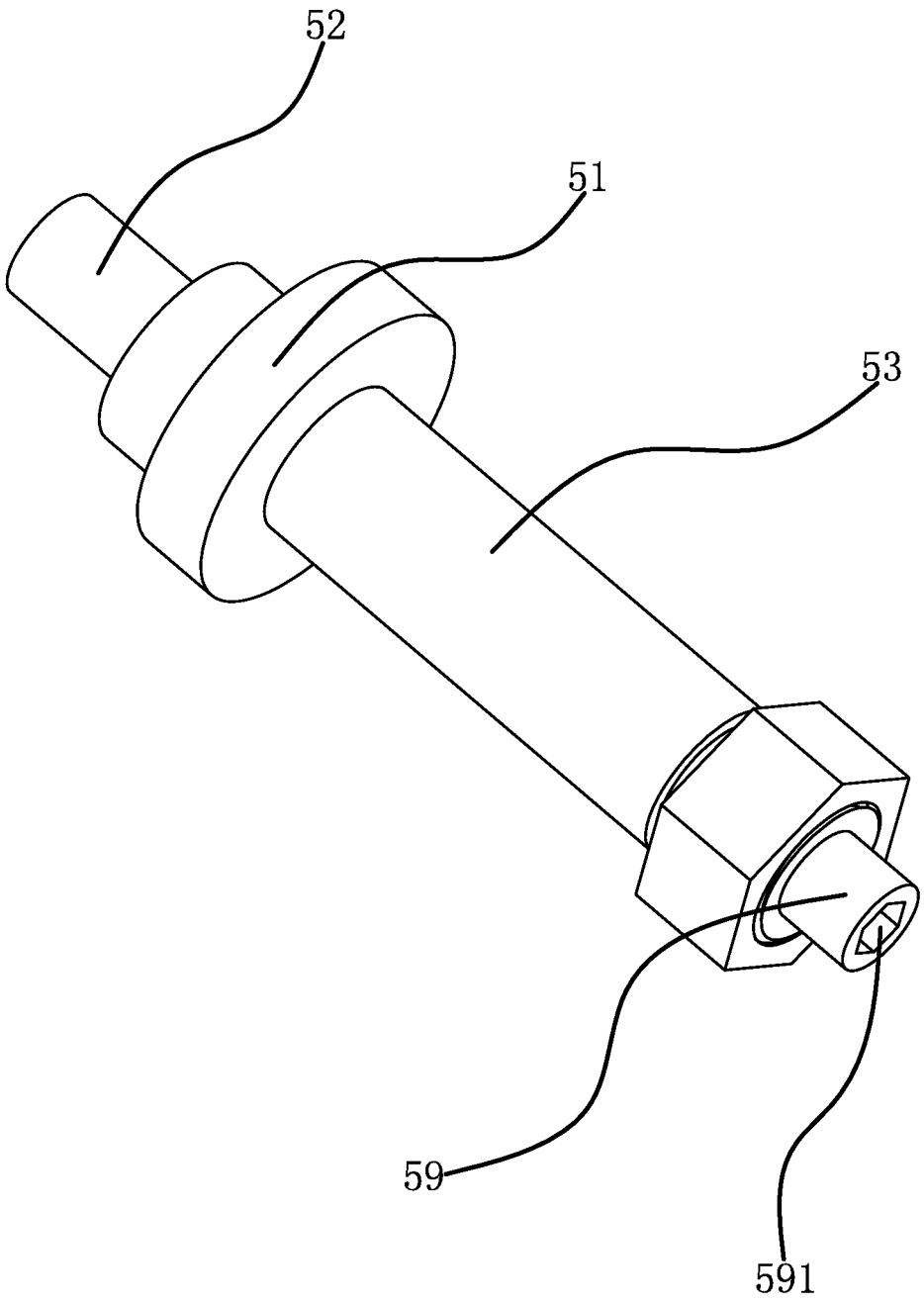
FIG. 12 is a perspective view of one embodiment of the locating crankshaft while an inner hex hole is arranged on the locating part.

The structure of the scroll compressor is basically the same as that of the first embodiment. The differences are:

As shown in FIG. 12, the locating structure comprises a locating part (59) on the end face of the locating crankshaft (5). An inner hex hole (591) is arranged on the end face of the locating part (59) allowing the locating part (59) to be circumferentially positioned by an Allen wrench or other tools.

The description of the preferred embodiments thereof serves only as an illustration of the scope of the invention. It will be understood by those skilled in the art that various changes or supplements in form and details may be made therein without departing from the scope of the invention as defined by the appended claims.

Although the terms of Fixed Bearing Seat (1), Second Bearing Bore (11), Second Bearing (12) and etc. are often used herein, it does not exclude the possibility to use any other terms. Using such terms is only to describe or explain the scope of the present invention more conveniently. Any additional restrictions are contrary to the present invention.

LIST OF REFERENCE NUMERALS

1 Fixed Bearing Seat
11 Second Bearing Bore
12 Second Bearing
13 Through Hole
14 Scroll Fixed Disk
15 Scroll Orbiting Disk
31 Heat Sink
322 Peak
323 Trough
324 First Prop
325 Second Prop
326 Inlet Part
327 Outlet Part
33 Air Duct
331 Air Inlet
332 Air Outlet
36 Zone
4 Orbiting Disk Bearing Seat
41 First Bearing Bore
42 First Bearing
5 Locating Crankshaft
51 Crank Arm
52 First Transmission Part
53 Second Transmission Part
54 Abutting Edge
55 Abutting Boss
56 Straight Slot
57 Cross Slot
58 Locating Hole
59 Locating Part
591 Inner Hex Hole
6 Adjusting gasket
7 First Locking Plate
8 Second Locking Plate
9 Locking Nut
91 Operation Hole
92 Operation Dent

What is claimed is:

1. A scroll compressor comprising:

a fixed bearing seat (1);

a scroll fixed disk (2);

a scroll orbiting disk (3);

an orbiting disk bearing seat (4);

three first bearing bores (41) circumferentially on an end face of the orbiting disk bearing seat (4);

three second bearing bores (11) corresponding to three first bearing bores (41) circumferentially on an end face of the fixed bearing seat (1); and a locating crankshaft (5) arranged between a corresponding first bearing bore (41) and a corresponding second bearing bore (11);

wherein the scroll fixed disk (2) is fixed to the fixed bearing seat (1), and the orbiting disk bearing seat (4) is located inside the fixed bearing seat (1);

wherein the scroll orbiting disk (3) is fixed to the orbiting disk bearing seat (4), and the scroll orbiting disk (3) matches the scroll fixed disk (2);

wherein a front end of the locating crankshaft (5) is rotatably connected inside the first bearing bore (41) through a first bearing (42), and a rear end of the locating crankshaft (5) is rotatably connected inside the second bearing bore (11) through a second bearing (12);

wherein there is a through hole (13) on a bottom face of the second bearing bore (11), passing through a rear end of the fixed bearing seat (1);

wherein a rear end of the locating crankshaft (5) passes through the second bearing (12) and is inserted inside the through hole (13);

wherein an end on which the locating crankshaft (5) passes through the second bearing (12) is screw connected with a locking nut (9) for locating the second bearing (12);

wherein a locating structure comprises a locating part (59) arranged on the rear end face of the locating crankshaft (5) to prevent the locating crankshaft (5) from rotating when the locking nut (9) is tightened;

wherein on an outer wall of the rear end of the locating crankshaft (5), there are circumferentially external threads, and the locking nut (9) fits the external threads of the locating crankshaft (5); and wherein when the locking nut (9) is tightened, the locking nut (9) presses against an inner end face of an inner race of the second bearing (12).

2. The scroll compressor as claimed in claim 1 wherein the locking nut (9) is an external hex nut.

3. The scroll compressor as claimed in claim 1 wherein several operation holes (91) are arranged circumferentially on a rear end face of the locking nut (9).

4. The scroll compressor as claimed in claim 1 wherein a straight slot (56), a cross slot (57), or several locating holes (58) are arranged on an end face of the locating part (59).

5. The scroll compressor as claimed in claim 1 wherein the locating part (59) is flat or is a column with a polygonal cross section; and wherein the locating part (59) stretches out of the through hole (13) or the locating part (59) is located outside the through hole (13).

6. The scroll compressor as claimed in claim 1 wherein the locating crankshaft (5) comprises a disk-shaped crank arm (51);

wherein perpendicularly, there is a columnar first transmission part (52) on a first side of the crank arm (51), and, perpendicularly, there is a columnar second transmission part (53) on a second side of the crank arm (51);

wherein the first transmission part (52) and the second transmission part (53) are arranged in parallel but eccentrically; and wherein the first transmission part (52) is connected to the first bearing (42), and the second transmission part (53) is connected to the second bearing (12).

7. The scroll compressor as claimed in claim 6 wherein there is an abutting edge (54) on a side of the crank arm (51), surrounding the second transmission part (53); and wherein when the locking nut (9) is tightened, an outer end face of an inner race of the second bearing (12) presses against an end face of the abutting edge (54).

8. The scroll compressor as claimed in claim 7 wherein a second locking plate (8) is fixed to the fixed bearing seat (1), and an adjusting gasket (6) is arranged between the second bearing (12) and a bottom of the second bearing bore (11);

wherein the second locking plate (8) presses against an outer end face of an outer race of the second bearing (12); and wherein under an action of the second locking plate (8), an inner end face of the outer race of the second bearing (12) presses against the adjusting gasket (6).

9. The scroll compressor as claimed in claim 6 wherein a first locking plate (7) is fixed to the orbiting disk bearing seat (4), and the first locking plate (7) presses against an outer end face of an outer race of the first bearing (42); and wherein there is an abutting boss (55) on a side of the crank arm (51), surrounding the first transmission part (52), and the abutting boss (55) presses against an outer end face of an inner race of the first bearing (42).

10. The scroll compressor as claimed in claim 1 wherein several operation dents (92) are arranged circumferentially along an edge of the rear end face of the locking nut (9).

* * * * *